US009604262B2

(12) United States Patent
Nash et al.

(10) Patent No.: US 9,604,262 B2
(45) Date of Patent: Mar. 28, 2017

(54) AIR CANNON AND SONIC HORN COMBINATION FOR DISLODGING ACCUMULATED BULK MATERIAL

(71) Applicant: Martin Engineering Company, Neponset, IL (US)

(72) Inventors: Joel Nash, Neponset, IL (US); Jefferson Landers Shelton, Neponset, IL (US); Jefferson Logan Shelton, Neponset, IL (US); Joe Kennedy, Neponset, IL (US)

(73) Assignee: Martin Engineering Company, Neponset, IL (US)

( * ) Notice: Subject to any disclaimer, the term of this patent is extended or adjusted under 35 U.S.C. 154(b) by 75 days.

(21) Appl. No.: 14/631,422

(22) Filed: Feb. 25, 2015

(65) Prior Publication Data

US 2016/0243598 A1 Aug. 25, 2016

(51) Int. Cl.

| | |
|---|---|
| ***B08B 5/00*** | (2006.01) |
| ***B08B 7/02*** | (2006.01) |
| *A47L 5/14* | (2006.01) |
| *B08B 9/093* | (2006.01) |
| *G10K 9/04* | (2006.01) |
| *B08B 7/00* | (2006.01) |

(52) U.S. Cl.

CPC ..... *B08B 7/026* (2013.01); *A47L 5/14* (2013.01); *B08B 5/00* (2013.01); *B08B 7/00* (2013.01); *B08B 9/093* (2013.01); *G10K 9/04* (2013.01)

(58) Field of Classification Search

CPC .... B08B 5/00; B08B 7/00; B08B 7/02; B08B 7/04; B08B 9/093; A47L 5/14; G10K 9/04

IPC ..... B08B 5/00

See application file for complete search history.

(56) References Cited

U.S. PATENT DOCUMENTS 3,111,931 A * 11/1963 Bodine ..... G10K 9/04 116/137 A
6,964,709 B2 * 11/2005 Matsumoto ..... F22B 37/48 134/1
7,837,062 B2 * 11/2010 Pronschinske ..... B65D 88/703 222/195

* cited by examiner

*Primary Examiner* — David Redding
(74) *Attorney, Agent, or Firm* — Thompson Coburn LLP; Clyde L. Smith

(57) ABSTRACT

A combination air cannon and sonic horn for dislodging accumulated bulk material comprises an air cannon, a sonic horn, and a shared portion. The air cannon is configured to store pressurized gas and to periodically abruptly discharge the pressurized gas through a gas outlet. The sonic horn is configured to generate sound waves that that are emitted from the gas outlet. The outlet is formed on a nozzle having a unique configuration. The outlet can be oriented such that blasts of air from the air cannon pass over the accumulated bulk material and lift the bulk material into suspension via Bernoulli's law.

8 Claims, 3 Drawing Sheets

AIR CANNON AND SONIC HORN COMBINATION FOR DISLODGING ACCUMULATED BULK MATERIAL

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention relates generally to an apparatus for dislodging accumulated bulk material from surfaces of bulk material handling devices, such as kilns used in the cement and paper industries. More particularly, the invention relates to an apparatus comprising an air cannon portion and a sonic horn portion. The invention also pertains to a sonic horn having a unique sound outlet passageway configuration.

General Background

Air cannons are commonly used in the bulk material handling industry for dislodging accumulated bulk material deposits from surfaces of bulk material handling devices, such as kilns, hoppers, and transfer chutes. Sonic horns are also used to dislodge accumulated bulk material and/or prevent bulk material from accumulating. If not dislodged, such accumulated bulk material can interfere with operation of such bulk material handling devices.

Air cannons are comprised of a pressure vessel, a discharge valve, and a discharge passageway. The pressure vessel is periodically filled with pressurized gas, such as air, from a pressurized gas source. When the discharge valve is actuated, typically via gas pressure, the stored compressed gas in the pressure vessel escapes from the pressure vessel and is discharged into the discharge passageway. This process occurs very abruptly and converts the stored potential energy of the compressed gas into kinetic energy. The gas escapes from the gas passageway through an outlet, typically at supersonic speeds. The resulting blast of gas transfers much of its energy to the accumulated bulk material and thereby dislodges the accumulated bulk material from surfaces. Although the compressed gas is typically air, other gases such as nitrogen or carbon-dioxide are also sometimes used. Regardless of the composition of the gas, such a device is commonly and herein referred to as an air cannon.

Sonic horns, as they are known in the industry, are also commonly used for dislodging accumulated bulk material from surfaces of bulk material handling devices or preventing the accumulation thereof. A sonic horn generally comprises a sound generator and a sound passageway that directs and focuses the sound waves generated by the sound generator. Typically, the sound generators of sonic horns are activated periodically and are powered electrically or, more commonly, pneumatically. The sound waves generated by sonic horns are typically low frequency (less than 300 Hz) and high amplitude (120-145 dB). However, sonic horns are often configured to emit frequencies and amplitudes of sound that best resonate the bulk material within a particular bulk material handling device, and frequencies may be magnitudes higher. As a result of the vibrations, the structural bonds that have been formed between the accumulated bulk material itself and the surfaces of the bulk material handling device are broken, and the accumulated bulk material is dislodged. Similarly, the vibrations inhibit the accumulation of bulk material on the surfaces of the bulk material handling device.

Individually, air cannons and sonic horns each are advantageous in some regards and disadvantageous in others. For example, while air cannons are good at dislodging heavy buildup of accumulated bulk material, they do little to prevent such accumulation from occurring between the blasts of compressed gas. Conversely, although sonic horns are good at loosening bonds between accumulated bulk material particles and preventing such bonds from occurring, they are less effective when the bulk material accumulation is relatively thick. As a result of these strengths and weaknesses, air cannons and sonic horns are sometimes used in combination. However, doing so increases costs and complexity.

SUMMARY OF THE INVENTION

The present invention pertains to improvement upon methods and apparatus for dislodging accumulated bulk material from bulk material handling devices. More specifically, the present invention pertains to an air cannon and sonic horn in the form of a unitary apparatus. The present invention also pertains to a gas passageway outlet configured and adapted to discharge sound waves and blasts of gas. Still further, the present invention pertains to a method of directing a blast of gas over accumulated bulk material in a manner generating an updraft that lifts the accumulated bulk material into suspension.

In one aspect of the invention, a combination air cannon and sonic horn for dislodging accumulated bulk material comprises an air cannon, a sonic horn, and a shared portion. The air cannon has a pressure vessel that is operatively connected to a discharge passageway. The pressure vessel is configured and adapted to store pressurized gas and to abruptly discharge the pressurized gas into and through the discharge passageway. The sonic horn has a sound generator that is operatively connected to a sound passageway. The sound generator is configured and adapted to generate sound waves that travel from the sound generator and through the sound passageway. The shared portion has a gas outlet and a gas passageway. The gas passageway is configured and adapted to fluidly connect the gas outlet to the discharge passageway and to the sound passageway in a manner such that the sound waves and the pressurized gas can be discharged from the combination air cannon and sonic horn via the gas outlet.

Another aspect of the invention pertains to a method of dislodging accumulated bulk material particles that are at rest on a surface. The method comprises abruptly discharging stored pressurized gas from an air cannon out of a gas outlet. The outlet is elongate in a generally horizontal direction. The gas is discharged from the outlet in a direction intentionally aimed above the bulk material particles. The discharged gas causes an updraft of other gas to lift the particles of bulk material accumulated on the surface into suspension within the discharged gas and other gas.

In still another aspect of the invention, a sonic horn for dislodging accumulated bulk material comprises a sound generator operatively connected to a sound outlet. The sound generator is configured and adapted to generate sound waves and to emit the sound waves out of the sound outlet. The sound outlet is elongate in an elongate direction. The sound outlet is operatively connected to a gas passageway that extends upstream from the sound outlet. The gas passageway diverges in a direction perpendicular to the elongate direction as it extends upstream from the sound outlet.

Further features and advantages of the present invention, as well as the operation of the invention, are described in detail below with reference to the accompanying drawings.

Figure 1:
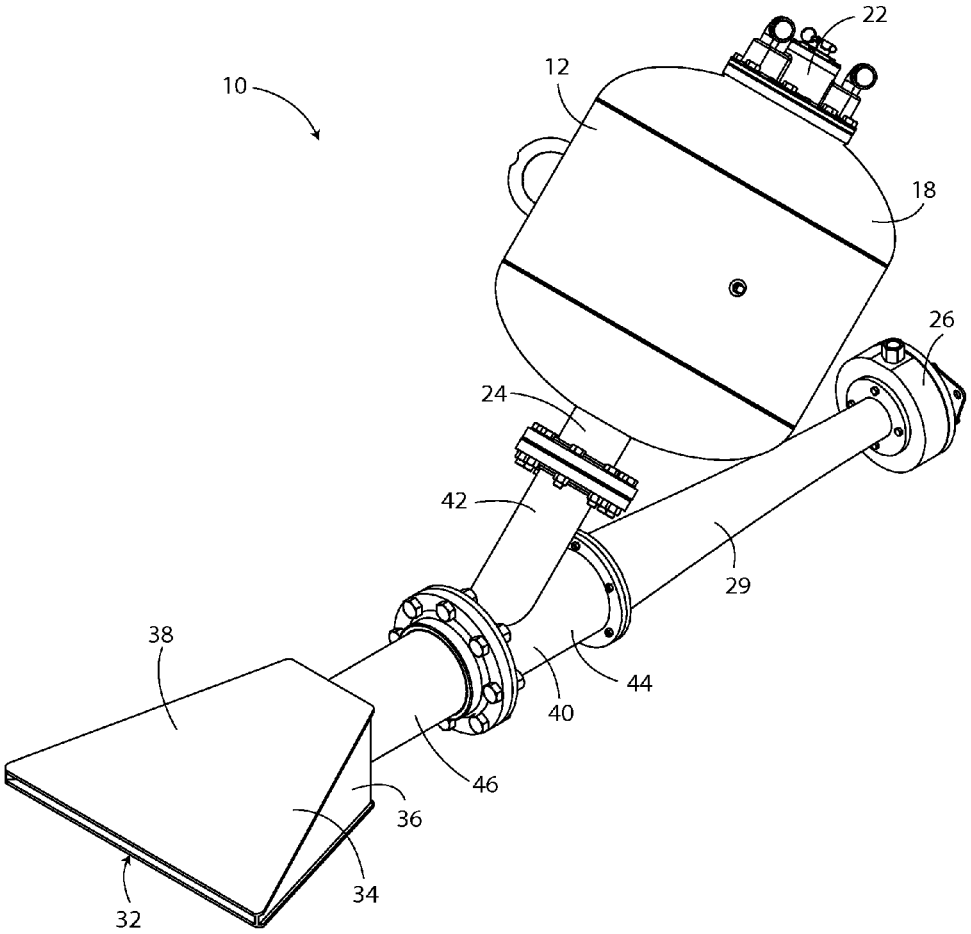
FIG. 1 depicts a perspective view of a combination air cannon and sonic horn in accordance with the invention.
Figure 2:
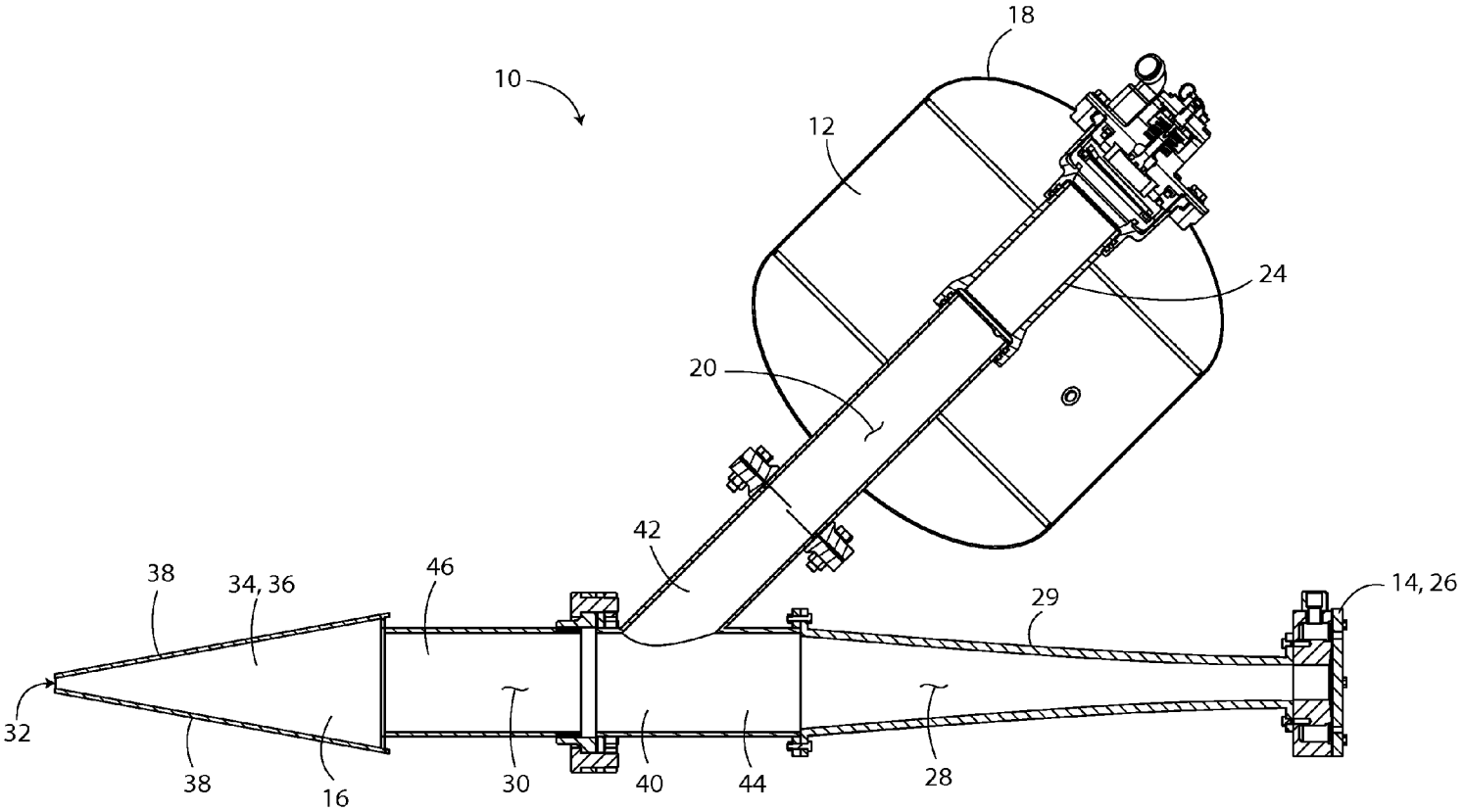
FIG. 2 depicts a cross-sectional view of the combination air cannon and sonic horn shown in FIG. 1, taken about the vertical plane of symmetry of the combination.
Figure 3:
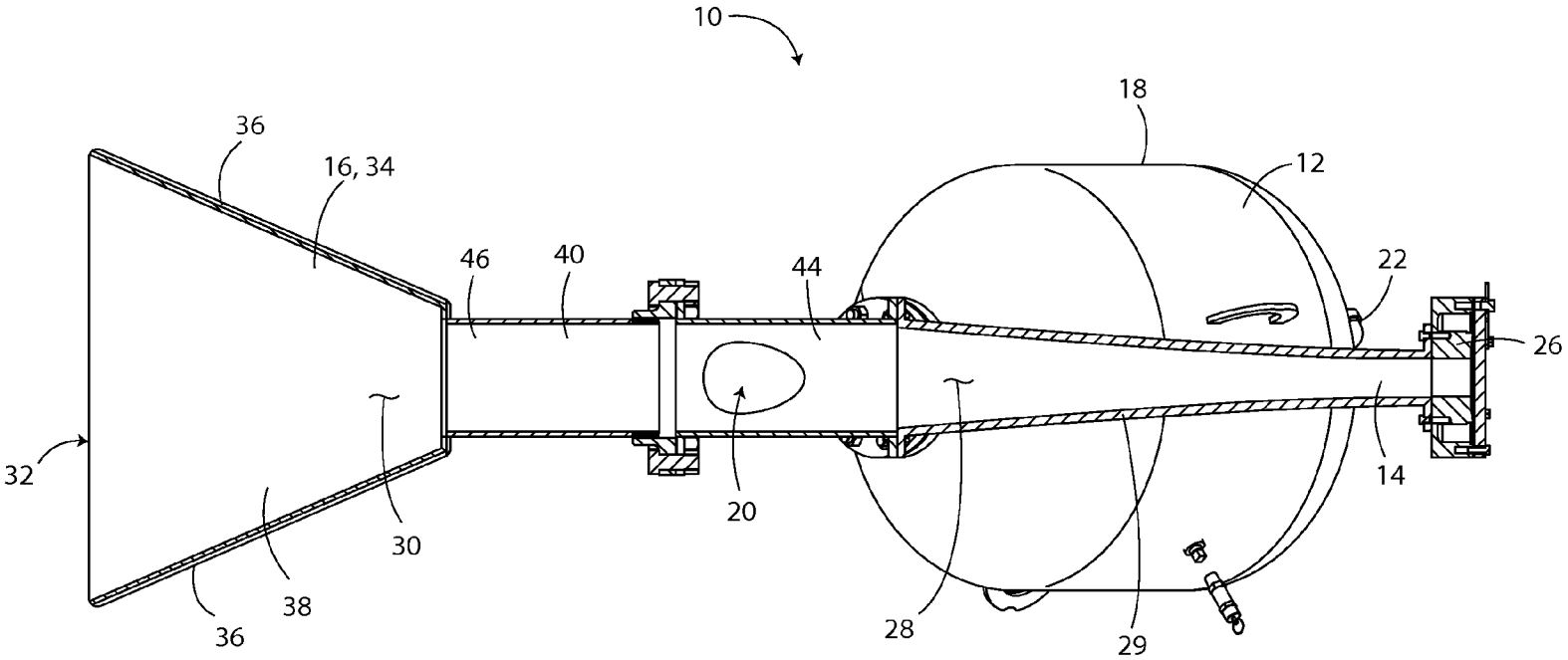
FIG. 3 depicts a cross-sectional view of the combination air cannon and sonic horn shown in FIGS. 1 and 2, taken about a horizontal plane that intersects the center axis of the shared gas passageway.

Reference numerals in the written specification and in the drawing figures indicate corresponding items.

DETAILED DESCRIPTION

FIG. 1 depicts a combination air cannon and sonic horn 10 in accordance with the present invention. The combination air cannon and sonic horn 10 comprises an air cannon 12, a sonic horn 14, and a shared portion 16.

The air cannon 12 comprises a pressure vessel 18, a discharge passageway 20 and a discharge valve 22. The pressure vessel 18 is configured to store pressurized gas supplied thereto from a source of pressurized gas (not shown). Preferably the gas enters the pressure vessel 18 through an inlet port (not shown) that is formed in the body of the discharge valve 22. The discharge valve 22 controls the release of the pressurized gas from the pressure vessel 18 into the discharge passageway 20. The discharge valve 22 is preferably pneumatically actuated and may be triggered to open when the pressure within the pressure vessel 18 reaches a threshold gauge pressure. Alternatively, a pressure signal from a remote source may be sent to the discharge valve 22 in a manner that causes the discharge valve to open. The discharge passageway is preferably defined by a series of cylindrical tubes 24. U.S. Pat. No. 7,837,062 discloses an air cannon of this type and is hereby incorporated by reference in its entirety.

The sonic horn 14 of the combination air cannon and sonic horn 10 has a sound generator 26 and sound passageway 28. The sound generator 26 is configured and adapted to generate sound waves that travel away from the sound generator and through the sound passageway 28. Preferably the cross-sectional area of the sound passageway 28 (perpendicular to the direction of sound wave travel) increases with increasing distance from the sound generator 26 so as to amplify sound wave traveling through the sound passageway away from the sound generator. Preferably a frusto-conical tube 29 defines the sound passageway 28. Also preferably, the sound generator 26 is a conventional pneumatically powered sound generator of the type well known in the art of bulk material handling devices. Alternatively, the sound generator 26 may be driven by an electrically powered voice coil.

The shared portion 16 of the combination air cannon and sonic horn 10 comprises a gas passageway 30 having an outlet 32. The portion of the gas passageway 30 nearest the outlet 32 preferably passes through a nozzle 34. The nozzle 34 preferably comprises side walls 36 that converge toward each as they extend from the outlet 32. In contrast, the nozzle 34 also preferably comprises top and bottom walls 38 that diverge apart from each other as they extend from the outlet 32. The outlet 32 preferably has a side-to-side width that is much greater than its top-to-bottom height. In view of the configuration of the nozzle 34, gas passing through the gas passageway 30 and out of the outlet 32 is discharged from the outlet in a fan-like manner and is also accelerated by the decreasing height between the top and bottom walls of the nozzle.

The shared portion 16 of the combination air cannon and sonic horn 10 further comprises a Y-shaped section 40. A first leg 42 of the Y-shaped section 40 is operatively and structurally connected to the air cannon 12. A second leg 44 of the Y-shaped section 40 is operatively and structurally connected to the sonic horn 14. The third leg 46 of the Y-shaped section 40 is operatively and structurally connected to the nozzle 34. As such, the shared portion 16 of the combination air cannon and sonic horn 10 is configured such that gas discharged from the air cannon 12 will pass through the gas passageway 30 of the shared portion, and thereafter exit through the outlet 32 of the nozzle 34. Similarly, the shared portion 16 of the combination air cannon and sonic horn 10 is also configured such that sound waves passing through the sound passageway 28 of the sonic horn 14 will thereafter pass through the gas passageway 30 of the shared portion, and thereafter exit through the outlet 32 of the nozzle 34. The legs 42, 44, 46 of the Y-shaped section 40 are preferably cylindrical. The second and third legs 44, 46 of the Y-shaped section 40 are preferably axially aligned with the sound passageway 28 of the sonic horn 14 (which is preferably linear). The first leg 42 of the Y-shaped section 40 extends at an angle from the other two legs, vertically upward and away from the nozzle 34. Preferably the first leg 42 extends perpendicular to the elongate direction of the outlet 32 of the nozzle 34. As such, the air cannon 10 is above and tilts away from the nozzle 34 of the shared portion 16 of the combination air cannon and sonic horn 10.

In operation, the pressure vessel 18 of the air cannon 12 is continuously supplied pressurized gas from the external source. As the pressure vessel 18 is being recharged with pressurized gas, the discharge valve 22 remains closed. Periodically a signal is sent to the discharge valve 22 that causes the discharge valve to open. Upon the opening of the discharge valve 22, an abrupt blast of the pressurized gas within the pressure vessel 18 blasts out of the pressure vessel and through the discharge passageway 20. From there, the blast of pressurized gas passes through the gas passageway 30 of the shared portion 16 and blasts out of the outlet 32 of the nozzle 34. The discharge valve 22 automatically closes following the blast in response to the depressurization of the pressure vessel 18. Thereafter the pressure vessel 18 begins to re-pressurize and the process is repeated.

Between the blasts of pressurized gas from the air cannon 12, the sound generator 26 sonic horn 14 may be activated in a manner causing sound waves to travel through the sound passageway and thereafter through the gas passageway 30 of the shared portion 16, ultimately being emitted from the outlet 32 of the nozzle 34. Alternatively, the operation of the sound generator 26 coincides with the discharge of compressed gas from the air cannon 12. Thus, the activation of the air cannon 12 and activation of the sonic horn 14 need not be synchronized in any manner. However, preferably they are synchronized and preferably the sonic horn 14 is activated periodically several times between blasts from the air cannon 12.

In some situations, the combination air cannon and sonic horn 10 is preferably attached to a wall of the bulk material handling device that it services in a manner such that the air cannon 12 and sonic horn 14 are external to the bulk material handling device, and such that the nozzle 34 (or at least the outlet 32 of the nozzle) is internal to the bulk material handling device. In other situations, for example, when the bulk material handling device does not have a closed interior, the combination air cannon and sonic horn 10 can be attached to any portion of the structure of the bulk handling equipment or it could even be mounted independently on its own cart or stand.

A preferred method of operating the combination air cannon and sonic horn 10 involves orienting the combination air cannon and sonic horn relative to accumulated bulk material in a manner such that blasts of gas discharge from the combination air cannon and sonic horn are directed to pass slightly over or to the side of the bulk material. In accordance with Bernoulli's law, the fast moving blast of gas draws adjacent gas radially inward toward the blast of gas. This has a tendency to lift and separate the bulk material particles (as opposed to moving the particles with direct compressive force by aiming the blast straight toward the bulk material). The particles then become temporarily suspended in the gas. This method is very effective at dislodging accumulated bulk material from grates or the like that are bounded by gas on both sides.

In view of the foregoing, it should be appreciated that the invention disclosed herein has advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations unless specifically noted. Still further, the order in which the steps of any method claim that follows are presented and should not be construed in a manner limiting the order in which such steps must be performed.

What is claimed is:

1. A combination air cannon and sonic horn for dislodging accumulated bulk material, the apparatus comprising:

an air cannon having a pressure vessel operatively connected to a discharge passageway, the pressure vessel being configured and adapted to store pressurized gas and to abruptly discharge the pressurized gas into and through the discharge passageway;

a sonic horn having a sound generator operatively connected to a sound passageway, the sound generator being configured and adapted to generate sound waves that travel from the sound generator and through the sound passageway; and a shared portion having a gas outlet and a gas passageway, the gas passageway being configured and adapted to fluidly connect the gas outlet to the discharge passageway and to the sound passageway in a manner such that the sound waves and the pressurized gas can be discharged from the combination air cannon and sonic horn via the gas outlet.

2. A combination air cannon and sonic horn in accordance with claim 1 wherein the sound passageway has a cross-sectional area that increases as it extends downstream away from the sound generator.

3. A combination air cannon and sonic horn in accordance with claim 1 wherein the gas outlet is elongate in an elongate direction.

4. A combination air cannon and sonic horn in accordance with claim 3 wherein the gas passageway of the shared portion converges in a direction parallel to the elongate direction as it extends upstream from the gas outlet.

5. A combination air cannon and sonic horn in accordance with claim 4 wherein the gas passageway of the shared portion diverges in a direction transverse to the elongate direction as it extends upstream from the gas outlet.

6. A combination air cannon and sonic horn in accordance with claim 1 wherein the discharge passageway and the sound passageway are both linear and intersect each other at an acute angle.

7. A combination air cannon and sonic horn in accordance with claim 1 wherein the gas passageway and the sound passageway are each linear and are coaxial.

8. A combination air cannon and sonic horn in accordance with claim 7 wherein the discharge passageway is linear, and discharge passageway and the sound passageway intersect each other at an acute angle.

* * * * *